US005116157A

United States Patent [19]

Gillum et al.

[11] Patent Number: 5,116,157

[45] Date of Patent: May 26, 1992

[54] LOCKING RING BINDER

[75] Inventors: Steven Gillum, Fairhaven; Luke Fuller, Acushnet, both of Mass.

[73] Assignee: U.S. Ring Binder Corporation, New Bedford, Mass.

[21] Appl. No.: 635,284

[22] Filed: Dec. 28, 1990

[51] Int. Cl.[5] ..... B42F 13/22; B42F 13/26

[52] U.S. Cl. ..... 402/38; 402/41

[58] Field of Search ..... 402/37, 38, 39, 41

[56] References Cited

U.S. PATENT DOCUMENTS

| | | | |
|---|---|---|---|
| 2,056,812 | 10/1936 | Unger | 402/38 |
| 2,673,564 | 3/1954 | Derringer | 402/38 |
| 3,098,490 | 7/1963 | Wance | 402/38 |
| 3,101,719 | 8/1963 | Vernon | 402/38 |
| 3,884,586 | 5/1975 | Michaelis et al. | 402/38 |
| 4,813,803 | 3/1989 | Gross | 402/38 |

*Primary Examiner*—Paul A. Bell

*Attorney, Agent, or Firm*—Hill, Van Santen, Steadman & Simpson

[57] ABSTRACT

A locking ring binder assembly has a resilient sheet metal cover and a pair of operating levers rotatably mounted on the covers. A detent consisting of a projection on the inside of the cover and a corresponding projection on the operating levers locks the binder in a closed position even though the operating levers are not rotated to an over center position.

6 Claims, 2 Drawing Sheets

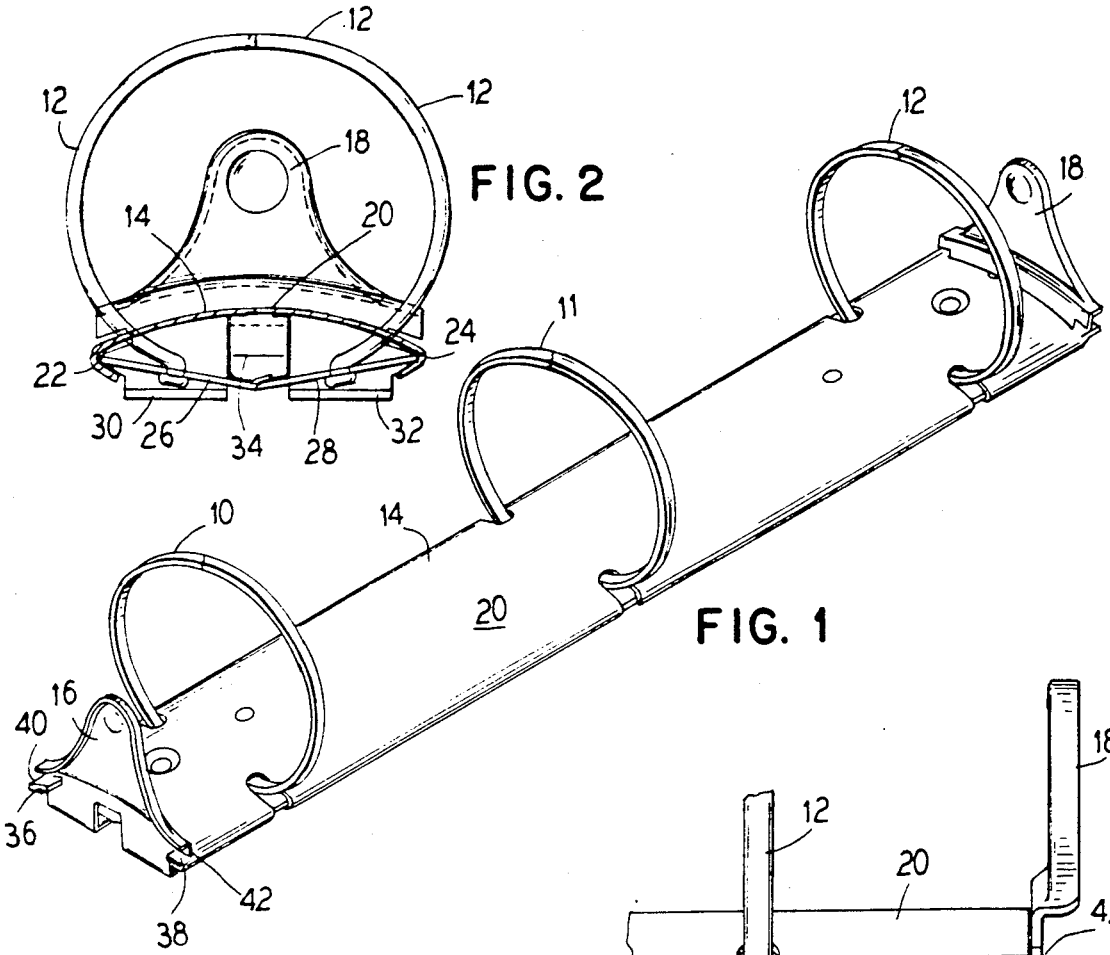
FIG. 2
FIG. 1
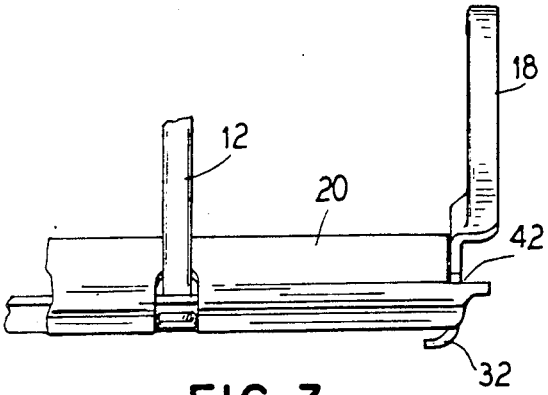
FIG. 3
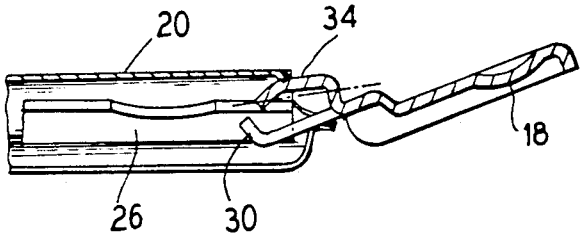
FIG. 4

LOCKING RING BINDER

BACKGROUND OF THE INVENTION

Various constructions of ring binders are known, in which a plurality of rings, normally closed, can be selectively opened to add or replace pages in a sheaf of pages held together by the rings. It is desirable that the rings be locked in closed position, for some applications, to prevent an inadvertent opening of the rings.

To that end, a variety of constructions have been proposed, generally using a pair of levers at opposite ends of the frame of the binder, by which the rings can be selectively opened. When the levers, sometimes referred to as triggers, are in closed position, an interlock arrangement prevents the rings from being opened inadvertently.

It is desirable to provide an improved construction for such a locking ring binder, to achieve the advantages of simplicity of construction, which promotes ease of manufacturing of a low cost locking ring binder.

SUMMARY OF THE INVENTION

It is a principal object of the present invention to provide an improved construction for a locking ring binder, by which the locking action is achieved by the interrelationship of a detent incorporating a first part carried by the cover or shield of the binder and a second part carried by a lever member adapted to selectively open the rings.

The construction of the present invention provides the advantage of an economical and easily assembled locking ring binder structure, in which the operating levers are rotatable through a relatively small angle, which is less than over center position relative to their axes of rotation.

These and other objects and advantages of the present invention will become manifest by an inspection of the accompanying drawings and the following description.

DESCRIPTION OF THE DRAWINGS

Reference will now be made to the accompanying drawings in which:

FIG. 1 is a perspective view of a ring binder construction incorporating an illustrative embodiment of the present invention;

FIG. 2 is a cross sectional view of a portion of the ring binder of FIG. 1;

FIG. 3 is a side view of a portion of the ring binder of FIG. 3;

FIG. 4 is a side elevational view, partly in cross section, of a portion of the ring binder of FIG. 1 with the operating lever shown in open position;

DESCRIPTION OF THE PREFERRED EMBODIMENTS

Figure 5:
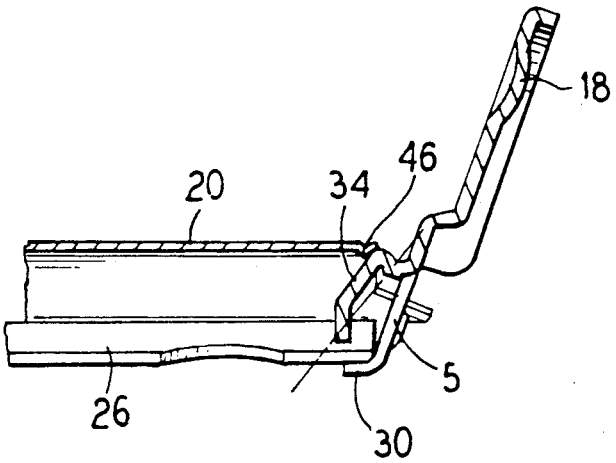
FIG. 5 is a side elevation, partly in cross sectional form of the ring binder of FIG. 1, with the operating lever shown in unlocked position.

Referring now to the drawings, FIG. 1 illustrates a perspective view of a locking ring binder incorporating the present invention. The binder incorporates a plurality of two-part rings 10, 11 and 12, which may be selectively opened and closed, a cover or shield member 14, and a pair of operating levers 16 and 18 at opposite ends of the cover. The operating levers 16 and 18 are secured to the cover in a way which allows them to be rotated from a locking position as shown in FIG. 1, toward an unlocked position, in which the lever is moved away from the rings 10 and 12.

When the levers 16 and 18 are moved to their unlocked position, the rings 10, 11 and 12 may be opened manually if desired. However, if the levers 16 and 18 are moved with a continued rotation, via beyond their unlocked position, they themselves force open the rings 10 and 12.

The cover 14 is formed of resilient sheet material (FIG. 2), with a cylindrical upper surface 20, with U-shaped side margins 22 and 24, which trap a pair of hinge leaves or ribs 26 and 28, to which three parts of the rings 10, 11 and 12 are firmly connected. When the hinge leaves are in the position illustrated in FIG. 2, they form a "V", and the two-part rings are closed. If a force is applied to cause the hinge plates 26 and 28 to move upwardly, to form an inverted "V", then the righthand ring half 12*a* is rotated in a clockwise direction, and the half 12*b* is rotated in a counterclockwise direction, to open the rings. This movement is facilitated by a pair of L-shaped actuators 30 and 32, formed at the bottom of each of the levers 16 and 8. The actuators 30 and 32 move the hinge leaves 26 and 28 into their upper position as the levers 16 and 18 are rotated, so that the actuators 30 and 32 bear on the underside of the leaves 26 and 28 to force them upwardly. This occurs when the lever 16 and 18 are rotated from the locked position to the open position. In like manner, when the levers 16 and 18 are rotated from their open position to their locked position, the leaves 26 and 28 are forced downwardly to form the V-formation illustrated in FIG. 2. This occurs by means of a tongue 34, which is provided at a center location in each of the levers 16 and 18.

The levers 16 and 18 are secured to the cover member 20, by virtue of tabs 36 and 38, formed integrally with the cover member 14, which are received in slots 40 and 42 formed at the side edges of the levers 16 and 18. The tabs 36 and 38 are bent over, to retain the levers 16 and 18 in position at the ends of the cover member, but the slots 40 and 42 are sufficiently large to allow each of the levers 16 and 18 to rotate relative to the cover member, while being held in position by the bent over tabs 36 and 38.

Figure 6:
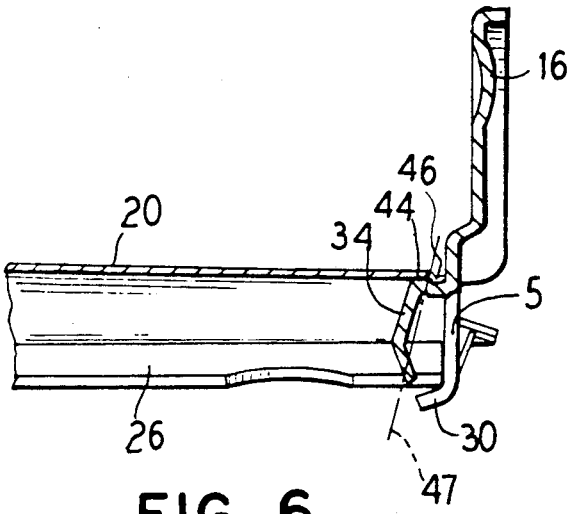
FIG. 6 is a side elevational view, partly in cross section, of the ring binder of FIG. 1 with the operating lever shown in locked position.
Figure 7:
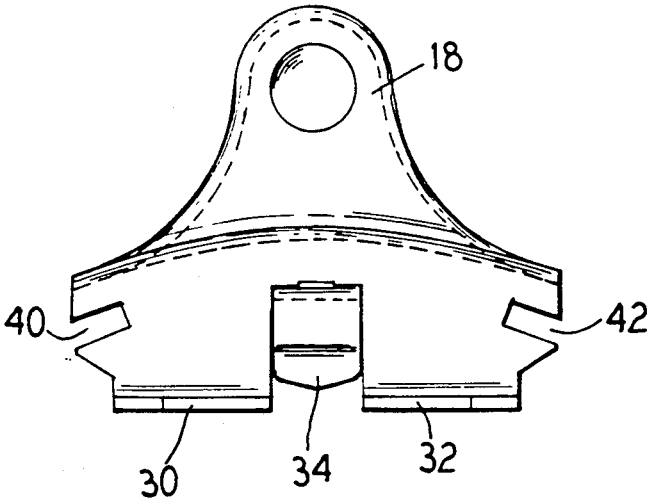
FIG. 7 is a plan view of one of the operating levers.

FIGS. 4, 5 and 6 illustrate the three positions of the lever members 16 and 18. FIG. 4 shows the open position, in which the lever member is rotated to its fully open position, so that the actuators 30 and 32 are rotated in a clockwise direction to force the leaves 26 and 28 upwardly as shown. During this rotation, the tongue 34 is also rotated in a clockwise direction to a raised position, which allows the leaves 26 and 28 to be raised.

When the lever is rotated from the position of FIG. 4 into the position of FIG. 5, the tongue 34 urges the leaves 26 and 28 downwardly, into the closed position, as illustrated in FIG. 5. However, in this position, the rings may be readily opened manually, in which case the leaves 26 and 28 are forced upwardly be means of manual pressure being applied thereto through the rings 10 and 12. This action causes the levers to rotate clockwise back to the opened position illustrated in FIG. 4.

When the levers are moved further in a counterclockwise direction from the position of FIG. 5 into the position of FIG. 6, the horizontal upper surface of the central tongue 34 reaches a position under the end of the cover 20. This brings a projection 44, located on the horizontal upper portion of the tongue 34, behind a corresponding projection 46 formed on the inner surface of the cover 20. As the projection 44 passes underneath and beyond the projection 46, the cover 20 is deformed slightly, and then springs back to hold the lever in its closed and locked position. The two projections 44 and 46 form a detent.

The continued counterclockwise rotation of the operating lever from a position of FIG. 5 into the position of FIG. 6 brings about a corresponding counterclockwise rotation of the tongue 34, so that the tongue 34 is engaged with the upper surface of the leaves 26 and 28. This holds the leaves in the downward locked position as shown in FIG. 6, as the detent projections 44 and 46 engage, with the projection 44 passing under and to the inside of the projection 46. This detent prevents the operating lever from rotating toward its unlocked or opened position merely by application of pressure to the rings 10, 11 and 12 and leaves 26 and 28, because the clockwise torque applied by any attempt to open the leaves is insufficient to force open the detent. Gentle manual pressure rotating the lever toward its clockwise direction readily releases the detent force, however, so that the lever can be moved clockwise to its unlocked position as illustrated in FIG. 5, and then further to its open position as illustrated in FIG. 4.

The dashed line 47 indicated in FIG. 6, which connects the point of contact of the tongue 34 with its axis of rotation, illustrates that the tongue 34 of the operating lever has not moved to an over center or toggled position, when the operating lever is moved to its locked position. The line extends downwardly toward the left, indicating that an attempted upward movement of the leaves 26 and 28 would result in a clockwise torque tending to open the detent. However, the detent is held in closed position by the downwardly directed spring force of the cover, and an attempted upward movement of the leaves 26 and 28 is not sufficient to force open the detent.

As shown in FIGS. 4, 5 and 6, the operating lever rotates about an axis 5, by virtue of the tabs 36 and 38 being trapped in the slots 40 and 42. As illustrated in FIG. 6, this axis is located to the right of the tongue 34, so that an attempted upward movement of the leaves 26 and 28 tends to impart a torque in the clockwise direction about the axis 5. However, as indicated above, this is insufficient to release the detent formed by the projections 44 and 46.

Figure 8:
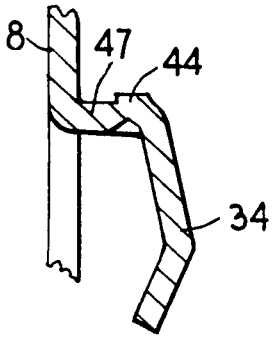
FIG. 8 is a partial side view of one of the operating levers.

Preferably, the projection 44 is an upwardly directed projection, centrally located on the upper surface of the horizontal portion 47 of the tongue 34, as best shown in FIG. 8. The projection 46 is preferably a downwardly deformed or staked portion at the outer edge of the sheet metal cover 20.

It will appreciated that the present invention is formed of relatively few separate parts, since the cover and operating levers incorporate, in just three members, all of the structure required for pivotally mounting the operating levers and for providing the detent projections for locking the levers in their closed position, as well as the actuators 30 and 32 for opening the rings, and the tongue 34 for closing the rings. That central location of the tongue 34 on the operating levers 16 and 18 facilitates closing the rings 10–12 with a minimum of force, and also simplifies the construction of the operating levers, as separate tongues are not required for the two hinged leaves or plates. Also, because the levers are not required to rotate so far as to reach an overcenter or toggled position, movement between opened and locked positions can be accomplished with a great economy of motion.

It is apparent that various modifications and additions may be made in the apparatus of the present invention without departing from the central features of novelty thereof, which are intended to be defined and secured by the appended claims.

What is claimed is:

1. A locking ring binder incorporating a plurality of ring portions secured to a pair of hinged plates, and a resilient cover member for urging the peripheral portions of said hinge plates toward each other, thereby to hold the rings in open position or closed position, and at least one operating lever rotatably mounted on said cover having an actuator located below said hinged plates for moving at least a portion of said hinged plates upwardly to force said rings into an open position, said operating lever having a tongue adapted to force at least a portion of said hinged plates downwardly as said operating lever is rotated to a closed position, and a detent incorporating a projection on said cover member and a corresponding projection on said operating lever, said detent becoming engaged when said operating lever is moved away from its open position, said detent tending to resist rotation of said operating lever as a result of a force supplied directly to said rings, whereby said leaves are locked in their closed position.

2. Apparatus according to claim 1, wherein said operating lever incorporates a pair of actuators, each of which is located under one of said hinged plates, for cooperating with the under surface of said plates, and wherein said operating lever has a centrally located downwardly extending tongue for cooperating with the upper surface of said hinge plates.

3. Apparatus according to claim 2, wherein said tongue is formed with a horizontal surface adapted to underlie said cover member when said operating lever is in its locked position, and said detent comprising a projection on said cover member, and a corresponding projection on the horizontal portion of said tongue.

4. Apparatus according to claim 3, wherein said cover member is formed of sheet material, and said detent incorporates a deformed projection at the edge margin of said cover.

5. Apparatus according to claim 3, wherein said detent incorporates a projection extending upwardly from the horizontal surface of said tongue.

6. Apparatus according to claim 2, wherein said tongue member extends inwardly of the axis of rotation about which said operating lever is rotated relative to said cover, and engages the upper surface of said hinged plates only at a location spaced inwardly from said axis of rotation, whereby rotation of said operating lever does not reach an over center position.

* * * * *